US007032253B2

(12) United States Patent
Colpitts et al.

(10) Patent No.: US 7,032,253 B2
(45) Date of Patent: Apr. 25, 2006

(54) SINK BASKET AND PLUG ASSEMBLY

(75) Inventors: Peter Colpitts, Uxbridge (CA); Scott Nelson, Uxbridge (CA)

(73) Assignee: Martin Tracy, (CA)

( * ) Notice: Subject to any disclaimer, the term of this patent is extended or adjusted under 35 U.S.C. 154(b) by 55 days.

(21) Appl. No.: 10/759,203

(22) Filed: Jan. 20, 2004

(65) Prior Publication Data

US 2005/0155142 A1 Jul. 21, 2005

(51) Int. Cl.
*E03C 1/262* (2006.01)

(52) U.S. Cl. ..... 4/287; 4/288

(58) Field of Classification Search ..... 4/287, 4/288, 290, 291
See application file for complete search history.

(56) References Cited

U.S. PATENT DOCUMENTS 1,704,529 A * 3/1929 Brotz ..... 4/287
1,817,283 A * 8/1931 Worswick ..... 4/291
3,881,201 A * 5/1975 Richards ..... 4/288 X
3,982,289 A 9/1976 Robbins ..... 4/292
4,320,540 A 3/1982 Leavens ..... 4/287
4,752,035 A * 6/1988 Felder ..... 4/287 X
D454,177 S 3/2002 Tracy ..... D23/261

* cited by examiner

*Primary Examiner*—Robert M. Fetsuga
(74) *Attorney, Agent, or Firm*—Merek, Blackmon & Voorhees, LLC

(57) ABSTRACT

A sink basket and plug assembly comprising a basket portion and a plug portion. The basket portion includes a well having at least one fluid passageway extending therethrough. The plug portion is at least partially receivable within the well and has an open and a closed position. When closed the plug restricts the passage of fluids through the fluid passageway. When open the plug permits the flow of fluid through said fluid passageway. At least one of the basket portion and the plug portion includes an indexing member and the other includes an indexing receiver. The indexing member is releasably receivable within the indexing receiver and retains the plug in its open position. Movement of the plug from its open to its closed position requires the application of a lifting force to the plug to dislodge the indexing member from the indexing receiver.

19 Claims, 8 Drawing Sheets

SINK BASKET AND PLUG ASSEMBLY

FIELD OF THE INVENTION

This invention relates to a sink basket and plug assembly as may be used in conjunction with the drain assembly of a sink.

BACKGROUND OF THE INVENTION

Both household and commercial sinks typically have drains in their bottom surfaces that allow for the contents of the sink to be evacuated and drained away. In most instances the drains also permit the insertion of a plug or other form of stopper to prevent the escape of fluids or materials from the sink when desired. For example, household kitchen sinks are commonly connected to a waste or drain pipe through the use of what is referred to generally as a basket assembly. The basket assembly includes a plug that may be received therein to close off the opening between the sink and the drain pipe. An example of one type of basket and plug assembly is described in U.S. Pat. No. 4,320,540, dated Mar. 23, 1982.

In most cases the plug portion of the basket assembly includes a form of strainer designed to strain or filter solid materials from waste water as it passes through to the drain pipe. The plug is also commonly designed such that it is moveable between an open and a closed position. When in their open position, existing plugs permit waste water from the sink to exit into the drain pipe while filtering solid materials therefrom. When closed, the plugs seal off the passageway to the drain pipe and prevent the escape of the contents of the sink.

While existing sink baskets and plugs have generally met with reasonable success, they nevertheless suffer from a number of limitations that both diminish their effectiveness and make them less attractive for use by a consumer. One of the primary limitations of currently existing sink baskets and their plugs and strainers relates to the fact that it is often difficult to determine through a quick visual inspection whether the plug is in an open or a closed configuration. In addition, currently available plugs tend to often move between an open and a closed position through the application of a generally vertically oriented force. In the case of a kitchen sink, placing dishes or pots and pans over the plug can unintentionally force it into a closed position, preventing the escape of waste water from the sink. Commonly used sink baskets, plugs and strainers are also typically formed from stainless steel and are rarely colour coordinated with either the sink or the room within which the sink is located. Changing or replacing sink baskets tends to be a time consuming endeavour that requires the use of specialized tools and skill.

SUMMARY OF THE INVENTION

The invention therefore provides a sink basket and plug assembly that incorporates a structure that can be easily and positively moved between an open and a closed configuration, while at the same time presenting a means to quickly indicate through visual examination whether the plug is open or closed. The invention also provides for a such device that may be manufactured inexpensively, in any one of a wide variety of different colours, and that in one embodiment may be readily inserted into existing sinks without the use of tools or with professional assistance.

Accordingly, in one of its aspects the invention provides a sink basket and plug assembly comprising a basket portion, said basket portion including a well having at least one fluid passageway extending therethrough; and, a plug portion at least partially receivable within said well, said plug portion having an open and a closed position, when in said closed position said plug portion restricting the passage of fluids through said fluid passageway in said well, when in said open position said plug portion permitting the flow of fluid through said fluid passageway in said well, at least one of said basket portion and said plug portion including an indexing member and the other of said basket portion and said plug portion including an indexing receiver, said indexing member releasably receivable within said indexing receiver, when said indexing member received within said indexing receiver said plug portion retained in said open position, movement of said plug portion from said open position to said closed position requiring the application of a lifting force to said plug portion to dislodge said indexing member from said indexing receiver.

In a further aspect the invention provides a sink basket and plug assembly comprising a basket portion, said basket portion including a well having a side surface and a bottom, said bottom of said well having at least one fluid passageway extending therethrough, said side surface having formed thereon at least one indexing receiver in the form of a generally vertically oriented channel having an enclosed lower end; and, a plug portion at least partially receivable within said well of said basket portion, said plug portion having an open and a closed position, when in said closed position said plug portion restricting the flow of fluids through said fluid passageway in said well, when in said open position said plug portion permitting the flow of fluids through said fluid passageway in said well, said plug portion including a side wall with at least one indexing member in the form of an outwardly extending tab, when said plug portion received within said well of said basket portion said tab releasably receivable within said channel on said basket portion and maintaining said plug portion in said open position.

The invention also provides for a sink basket and plug assembly comprising a basket portion, said basket portion including a well having a side surface and a bottom, said bottom of said well having at least one fluid passageway extending therethrough, said side surface including at least one indexing member in the form of an outwardly extending tab; and, a plug portion at least partially receivable within said well of said basket portion, said plug portion having an open and a closed position, when in said closed position said plug portion restricting the flow of fluids through said fluid passageway in said well, when in said open position said plug portion permitting the flow of fluids through said fluid passageway in said well, said plug portion including a side wall having at least one indexing receiver in the form of a generally vertically oriented channel having an enclosed upper end, when said plug portion received within said well of said basket portion said tab releasably receivable within said channel on said plug portion to maintain said plug portion in said open position.

In a further aspect the invention concerns a sink basket and plug assembly comprising a basket portion, said basket portion including a well having at least one fluid passageway extending therethrough; and, a plug portion at least partially receivable within said well, said plug portion having an open and a closed position, when in said closed position said plug portion restricting the passage of fluids through said fluid passageway in said well, when in said open position said plug portion permitting the flow of fluid through said fluid passageway in said well, at least one of said basket portion and said plug portion including an indexing receiver and the other of said basket portion and said plug portion including an indexing member releasably receivable within said indexing receiver when said plug portion is situated within said well, movement of said plug portion when said indexing member is within said indexing receiver first requiring the application of a lifting force to said plug portion to separate said indexing member from said indexing receiver.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
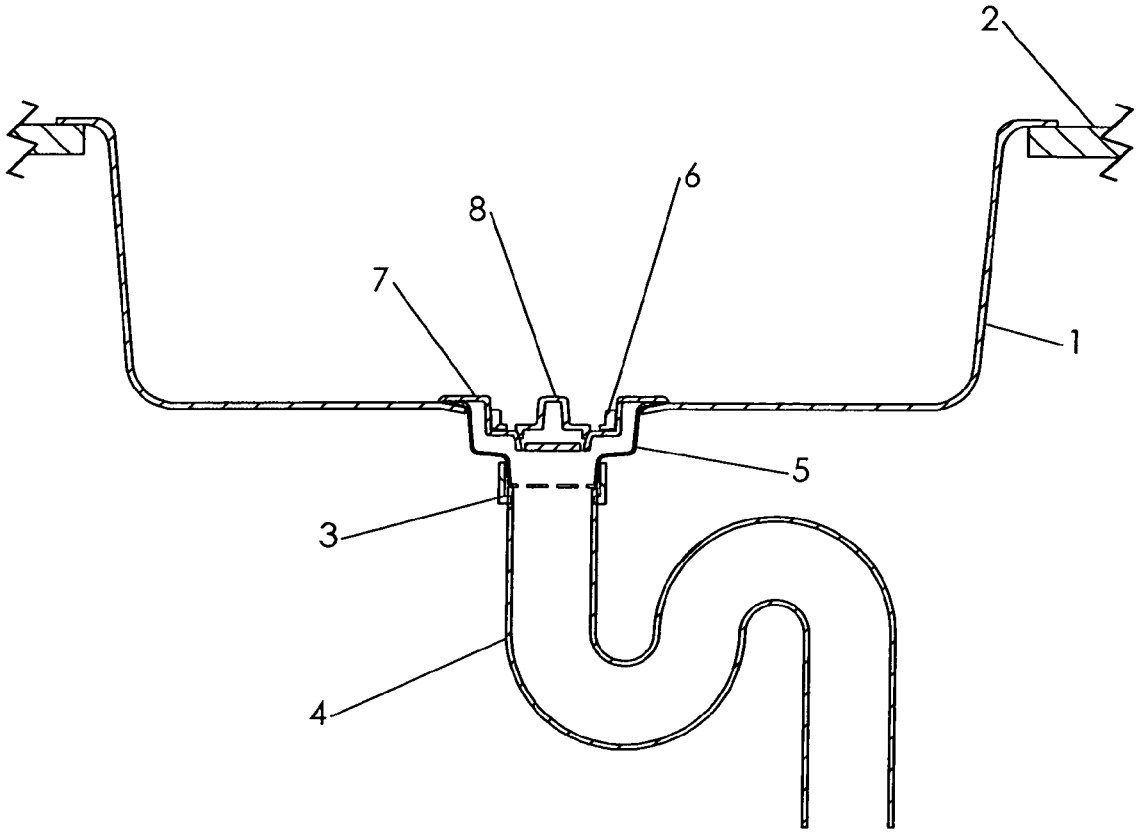
FIG. 1 is a vertical side sectional view through a typical sink having inserted therein a sink basket and plug assembly in accordance with one of the preferred embodiments of the present invention.
Figure 2:
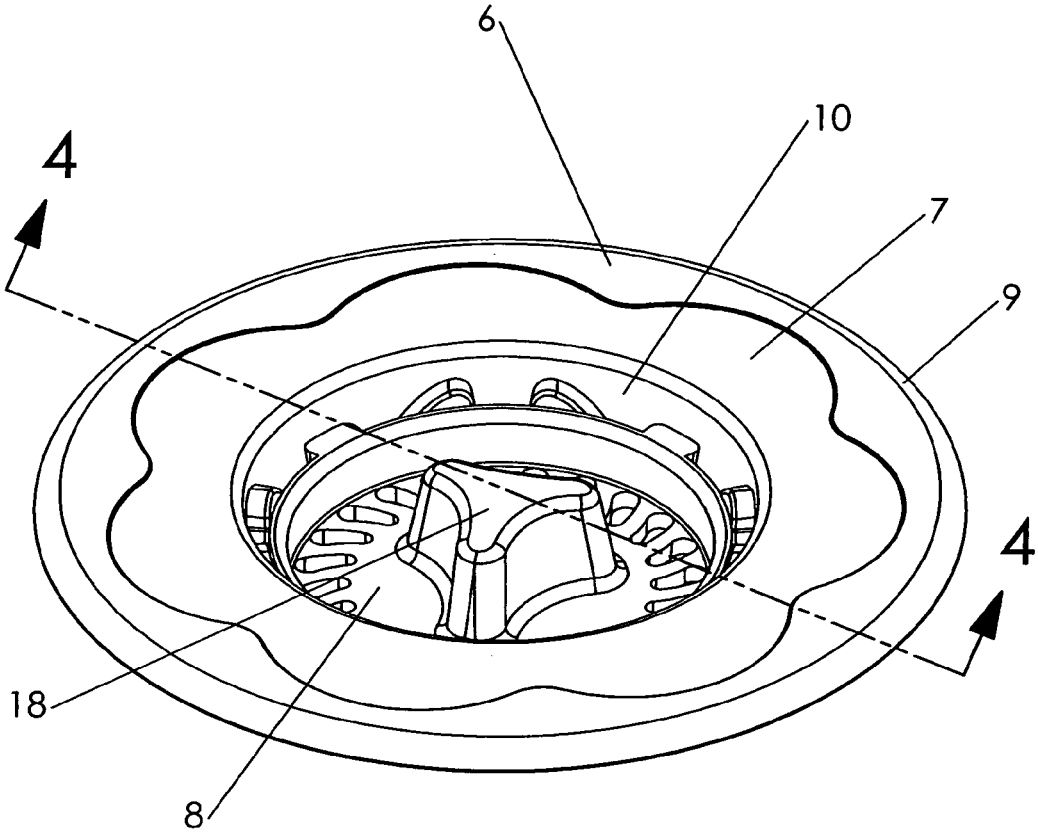
FIG. 2 is an upper side perspective view of the sink basket and plug assembly shown in FIG. 1 in its closed or plugged position.
Figure 3:
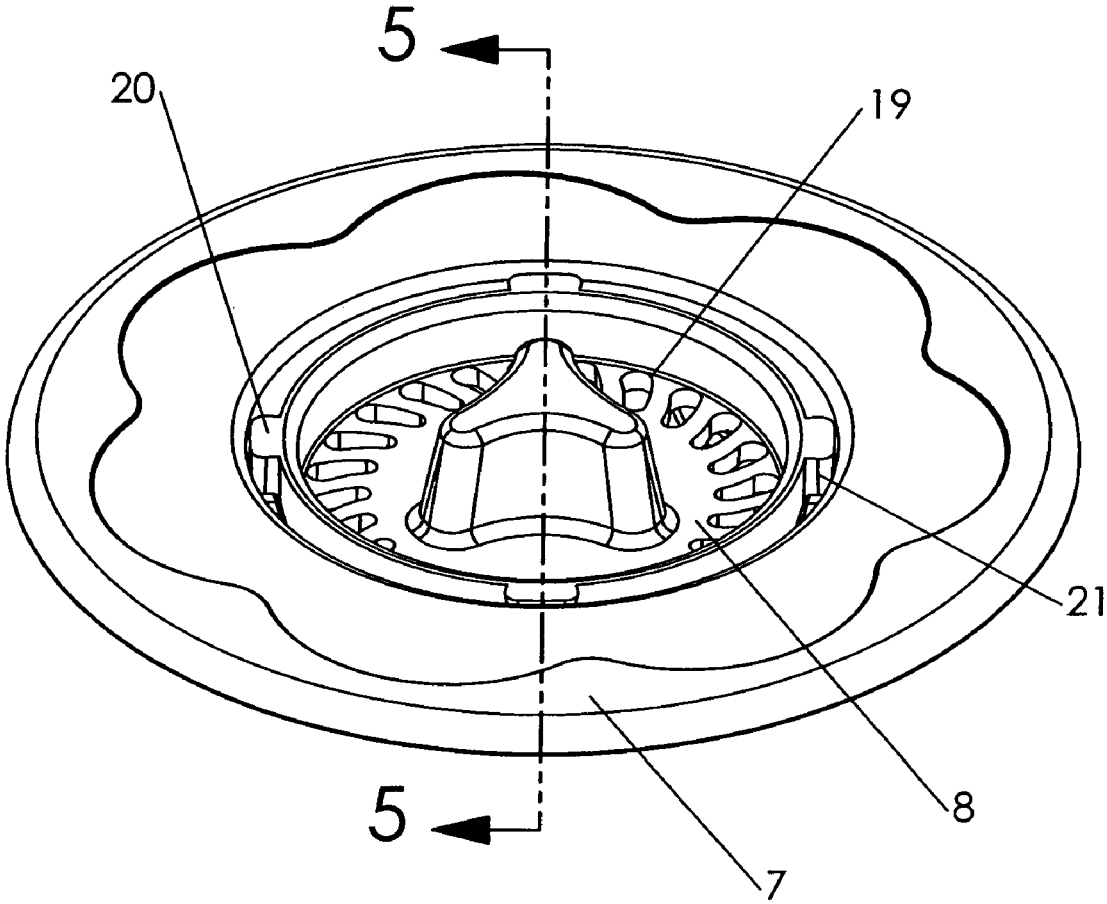
FIG. 3 is an upper side perspective view of the sink basket and plug assembly shown in FIG. 1 in its open or draining position.
Figure 4:
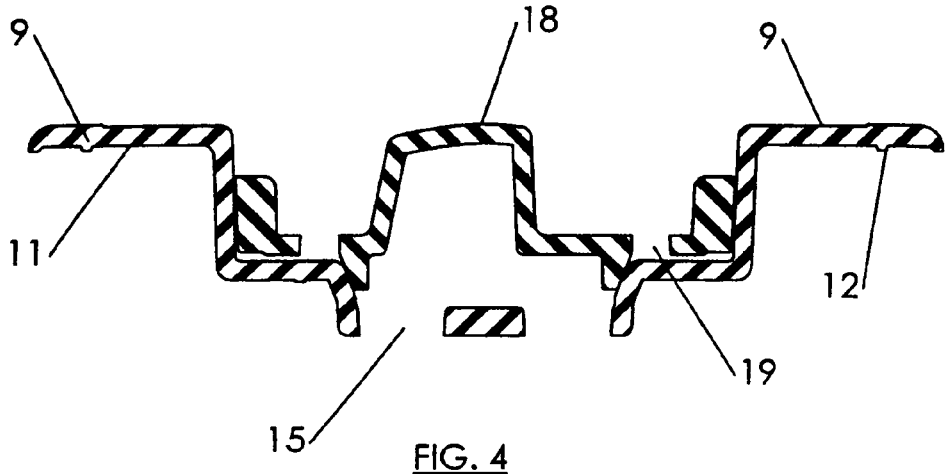
FIG. 4 is a sectional view taken along the line 4—4 in FIG. 2.
Figure 5:
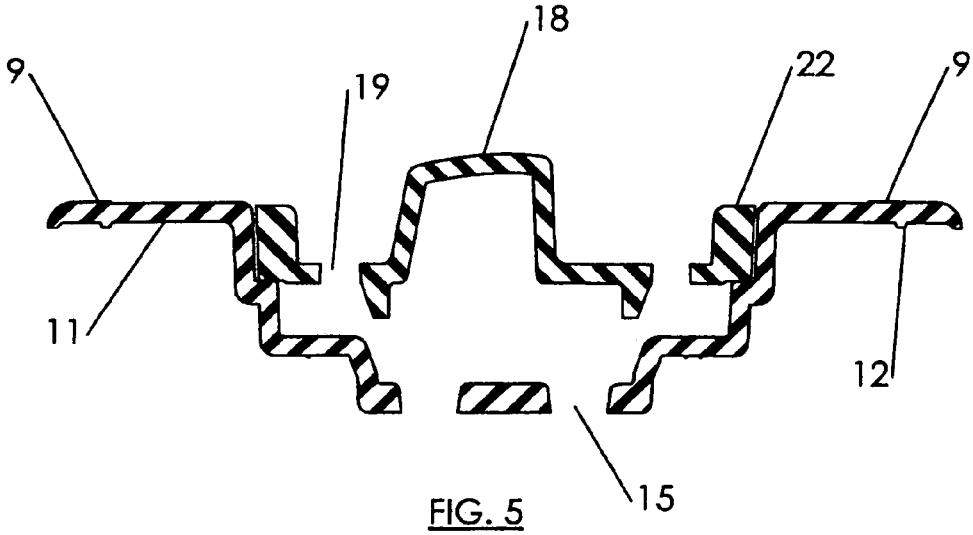
FIG. 5 is a sectional view taken along the line 5—5 in FIG. 3.

FIG. 1 shows in general cross section a typical sink 1 mounted in a counter top 2 and having a generally centrally located drain 3 connected to a drain or waste pipe 4. A standard sink basket 5 serves as a means to connect the sink's drain to the waste pipe. In accordance with one of the preferred embodiments of the invention there is provided a sink basket and plug assembly 6 that may be inserted into existing sink basket 5 without the use of tools or any specialized skill. In the embodiment shown, sink basket and plug assembly 6 is partially received in an existing sink basket without the need to remove the existing basket. It will, of course, be appreciated by those skilled in the art following a thorough understanding of the invention that in accordance with alternate embodiments the sink basket and plug assembly of the present invention may be used in isolation with sink 1 and may form the means to connect drain pipe 4 with sink drain 3. Regardless of whether sink basket and plug assembly 6 is used alone to connect the sink to the drain pipe, or in conjunction with an existing sink basket, its operation and as described below remains essentially the same.

The structure and operation of sink basket and plug assembly 6 in accordance with a preferred embodiment of the invention is shown in detail in FIGS. 2 through 8. Assembly 6 is comprised in general of a basket portion 7 and a plug portion 8. Basket portion 7 includes a laterally extending flange 9 positioned about a well 10. As indicated in the attached drawings, well 10 is generally cylindrical in nature and may be inserted into an existing sink basket or, as indicated above, may be connected directly to drain pipe 4. For aesthetic purposes flange 9 will also in most instances be circular in nature, however, it should be appreciated that a wide variety of other geometric shapes could also be utilized. The bottom surface 11 of flange 9 preferably includes a downwardly disposed sealing member 12 that engages the surface of sink 1 in order to help present a water and fluid tight seal between the flange and the surface of the sink.

As is common with most sink baskets, well 10 includes a side surface 13 and a bottom 14 with the bottom having at least one fluid passageway 15 extending therethrough. Depending upon the size and configuration of fluid passageway 15 any number of such passageways may extend through the bottom of well 10 to permit water and fluids to drain from sink 1 through well 10 and into drain pipe 4.

Plug portion 8 is designed and configured to be at least partially receivable within well 10. To that end, plug portion 8 is comprised of a base member 16 that is generally circular in shape and that has positioned about its circumference a generally cylindrical side portion 17. Secured to the upper surface of base 16 is a finger knob or handle member 18 used to both lift the plug vertically into and out of well 10, and also (for reasons that will be described in more detail) to facilitate in the application of a rotational force to plug portion 8. Plug portion 8 may include one or more fluid passageways 19 extending therethrough that effectively act as a strainer to at least partially strain solid and particulate materials from fluid flowing into well 11. As in the case of passageways 15, fluid passageways 19 within plug portion 8 may be formed in an extremely wide variety of different shapes and configurations depending largely upon the aesthetic value that is desired and the types of fluids to which the plug is expected to be exposed.

In operation, plug portion 8 has an open and a closed position. When in its closed position the plug is effectively seated against the interior of basket portion 7 and seals well 10 to restrict or prevent the passage of fluids from sink 1 into drain pipe 4. When the plug is moved to its open position (see FIGS. 3, 5 and 8) fluid is free to flow through passageways 19. Depending upon the dimensional tolerances between the cylindrical side of the plug and side surface of well 10 fluid may also flow between the exterior surface of the plug and the interior surface of the well. Fluid passing through or around plug portion 8 is permitted to flow into well 10 and eventually drain pipe 4.

In accordance with the invention, at least one of basket portion 7 and plug portion 8 includes an indexing member 20. The other of the basket and plug portions includes an indexing receiver 21. While the precise geometric configuration of indexing member 20 and indexing receiver 21 may vary, of importance is the ability for indexing member 20 to be releasably receivable within receiver 21. When the indexing member is received within the indexing receiver plug portion 8 will be retained in either its open or its closed position. Whether the plug is open or closed in this configuration will largely be a function of the particular structure of the indexing member, the indexing receiver, basket portion 7 and plug portion 8. For illustration purposes in the attached drawings the plug portion is retained in its open position when member 20 is situated within receiver 21.

In one aspect the invention contemplates an indexing member 20 comprised of at least one outwardly extending tab 22 positioned upon the cylindrical side surface 17 of plug portion 8. For stability purposes, in a further embodiment the indexing member may comprise at least three outwardly extending tabs. The attached figures show a plug portion having four tabs. Where indexing member 20 is comprised of one or more tabs, indexing receiver 21 is preferably comprised of one or more channels 23.

Figure 6:
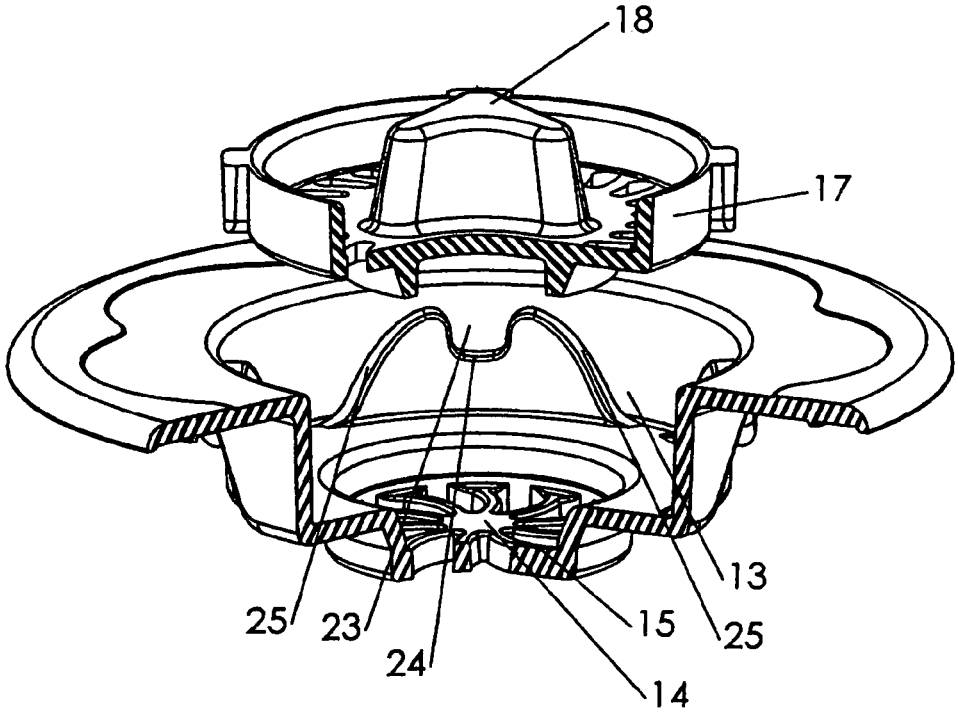
FIG. 6 is an exploded view, in partial cross-section, of the sink basket and plug assembly shown in FIG. 2.
Figure 7:
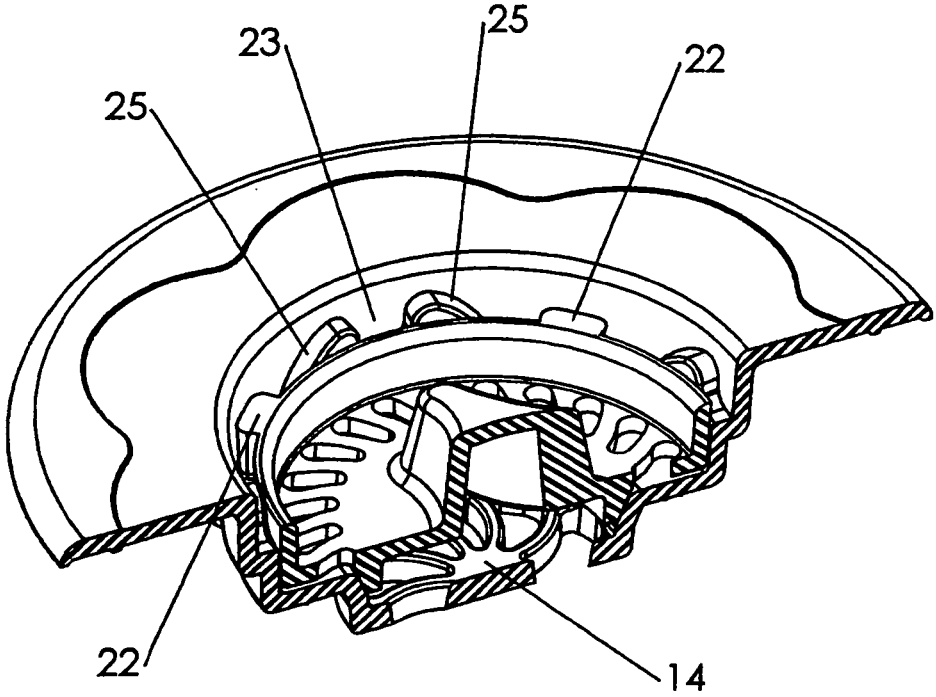
FIG. 7 is an upper side perspective and sectional view of the sink basket and plug assembly of FIG. 2.
Figure 8:
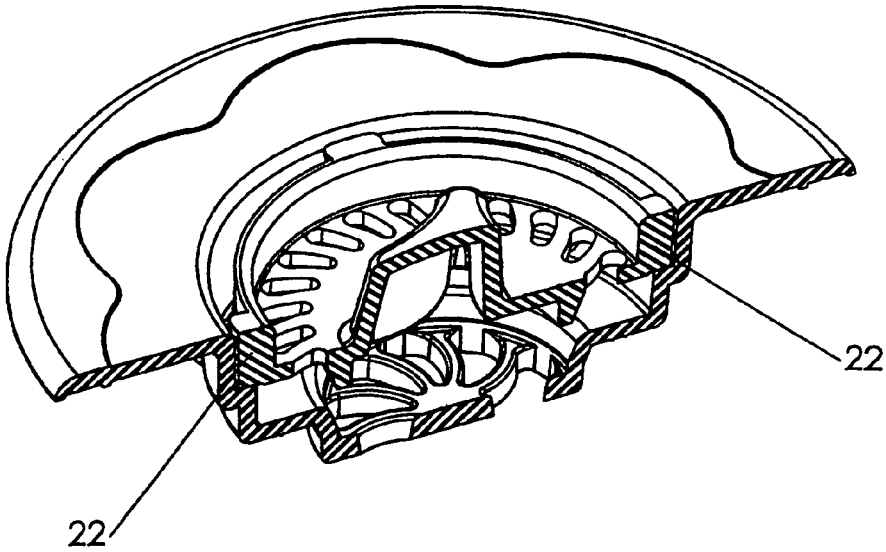
FIG. 8 is an upper side perspective and sectional view of the sink basket and plug assembly of FIG. 2.
Figure 9:
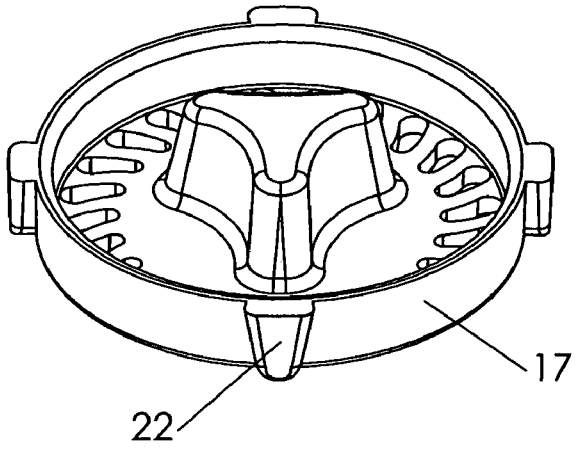
FIG. 9 is an upper side perspective view of the plug assembly shown in FIG. 2.
Figure 10:
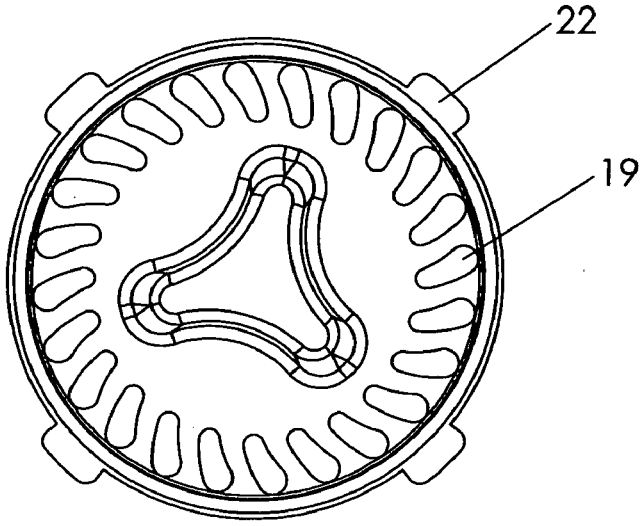
FIG. 10 is a plan view of the plug assembly shown in FIG. 9.
Figure 11:
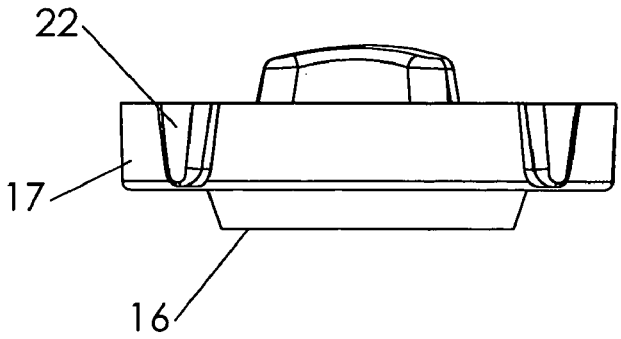
FIG. 11 is a side elevational view of the plug assembly shown in FIG. 9.

In the embodiment of the invention that is shown in the figures, channels 23 are formed upon the interior surface of side 13 of well 10. Channels 23 are preferably positioned in a generally vertical orientation (relative to the longitudinal axis of well 10) and have an open upper end and an enclosed lower end 24. Channels 23 are also dimensioned and configured so that tabs 22 on plug portion 8 may be releasably secured therein. The number of channels positioned on the side surface of well 10 will in most cases match the number of tabs on plug portion 8. For example, where plug portion 8 includes four tabs ideally well 10 will have four corresponding channels. It will also be appreciated that where more than one tab and more than one channel are utilized, the angular displacement of the respective channels should be the same as that of the tabs so that each of the tabs may be received within a corresponding channel. In FIG. 6 the tabs and channels are spaced apart at 90 degree intervals.

In order to facilitate movement of tabs 22 into and out of channels 23, a pair of ramps 25 may be situated on opposite sides of each channel. The ramps comprise a generally convex sloped surface (see FIG. 6) that present a pathway along which the tabs may travel to be directed into or out of channels 23. To establish a frame of reference, the ramp that is encountered by a tab when it is free from engagement with one of the channels and the plug is moving from its closed to its open position will be referred to as a leading ramp. Similarly, when a tab is received within a channel and plug portion 8 is rotated to remove the tab from the channel the ramp engaged by the tab will be referred to as a trailing ramp. Accordingly, it will be appreciated that depending upon whether plug portion 8 is rotated in a clockwise or a counterclockwise direction, a particular ramp may be either a leading or a trailing ramp.

Where channels 23 are formed upon the interior surface of the side of well 10, leading and trailing ramps 25 will also be positioned on the interior side surface of the well. The sloped surface of the leading ramps will thus have a tendency to cause tabs 22 to ride up along each ramp as the plug is rotated, effectively lifting plug portion 8 in a vertical direction and helping to urge the tabs into the channels. That is, in the embodiment shown in FIG. 6, when plug portion 8 is in its closed position rotation of the plug in either a clockwise or counter clockwise direction will cause tabs 22 to engage ramps 25 and ride upwardly along the exterior surface of the ramps until they are received within channels 23. At that point the plug portion will be in its open position and retained therein through the interlocking of tabs 22 and channels 23. To assist in the entry of the tabs into the channels, and to create a relatively tight fit therebetween, in one embodiment the tabs may have a generally triangular or keystone shape. The ability to transfer a rotational force to plug portion 8 is facilitated by the generally triangular shape of handle 18 that permits an operator to quickly grasp and rotate the plug in either a clockwise or counterclockwise direction. When in its open position (see FIG. 8) with tabs 22 retained within channel 23, water or fluid within the sink is permitted to flow around the exterior edges of the plug portion and through passageways 19.

When plug portion 8 is in its open position moving it to a closed position will first require the application of an upward or lifting force to dislodge tabs 22 from channels 23, and thereafter a rotational movement of the plug portion to enable the tabs to be offset from the channels. At that point rotation of the plug portion may continue until it reaches its closed position (see FIG. 7) or, alternatively, the plug may merely be released causing the tabs to ride downwardly along the surface of trailing ramps until the plug reaches its closed position. At that point the tabs will be situated at their lower resting point between adjacent leading and trailing ramps so that once again movement of the plug from its closed to its open position requires the application of a rotational force in either a clockwise or counterclockwise direction.

While in the embodiment of the invention that has been described tabs 22 are located upon the cylindrical side surface 17 of plug portion 8 with channels 23 located upon the inside surface of well 10, it should be noted that the relative positions of the tabs and channels could be reversed while not significantly altering either the scope or function of the invention. That is, rather than positioning tabs 22 on plug portion 8 they could be located on the interior side wall 13 of well 10 with corresponding channels 23 positioned on cylindrical side surface 17 of the plug portion. It should also be noted that the channels would preferably remain in a generally vertical orientation relative to the longitudinal axis of well 10, however, they will have enclosed upper ends and open lower ends. A leading and a trailing ramp will once again be situated on opposite sides of each channel. When in its open position plug portion 8 will be positioned with its channels received over the tabs on the side surface of the well such that the plug will be effectively hung from the tabs and maintained in an open position. Movement of the plug from its open to its closed position will still be accomplished in the manner described above, with the requirement to lift the plug slightly to disengage the channels from the tabs, and thereafter rotating the plug in either a clockwise or counterclockwise direction.

It will thus be understood from a complete understanding of the invention that the described sink basket and plug assembly presents a structure that can be easily and positively moved between an open and a closed position, while at the same time presenting a means to quickly indicate through visual examination whether the plug is open or closed. Furthermore, when open the assembly provides for the receipt of one or more tabs into one or more corresponding channels that prevents unintentional closing of the plug through the application of a downwardly directed vertical force. Moving the plug from its open to its closed position requires movement in two distinct and separate directions; namely, in an upwardly direction followed by clockwise or counterclockwise rotation. The assembly may be manufactured inexpensively and may be formed from a rubber, plastic, metal or other material. If desired, an antibacterial and/or deodorizer additive may be incorporated into the basket and/or the plug. It is also contemplated that the sink basket and plug assembly may take the form of an after-market product that may be readily inserted into an existing sink without the use of tools or professional assistance. Alternatively, the functional aspects of the invention may be incorporated into original sink baskets that accompany sinks when they are purchased or initially installed.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A sink basket and plug assembly comprising:

(i) a basket portion, said basket portion including a well having at least one fluid passageway extending therethrough; and, (ii) a plug portion at least partially receivable within said well, said plug portion having an open and a closed position, when in said closed position said plug portion restricting the passage of fluids through said fluid passageway in said well, when in said open position said plug portion permitting the flow of fluid through said fluid passageway in said well, at least one of said basket portion and said plug portion including an indexing member and the other of said basket portion and said plug portion including an indexing receiver having a leading ramp on one side thereof and a trailing ramp on the other side thereof, said indexing member being releasably receivable within said indexing receiver such that when said indexing member is received within said indexing receiver said plug portion is retained in said open position, when in said closed position rotation of said plug portion causes said indexing member to engage said leading ramp and urge said indexing member into said indexing receiver.

2. The device as claimed in claim 1 wherein said basket portion includes a laterally extending flange positioned thereabout, said flange sealingly engaging the surface of a sink when said basket portion is received within the drain of said sink.

3. The device as claimed in claim 2 wherein said flange includes a downwardly disposed sealing member that engages the surface of said sink and assists in preventing the flow of fluid between said flange and the surface of said sink.

4. The device as claimed in claim 1 wherein said plug portion includes at least one fluid passageway extending therethrough.

5. The device as claimed in claim 1 wherein said plug portion includes a plurality of fluid passageways extending therethrough, said plurality of fluid passageways comprising a strainer to at least partially strain particulate material from fluid flowing through said plurality of passageways.

6. The device as claimed in claim 1 wherein said indexing member comprises at least one outwardly extending tab positioned upon the surface of said plug portion.

7. The device as claimed in claim 6 wherein said indexing receiver comprises at least one channel formed upon the surface of said basket portion, said channel having one enclosed end and dimensioned and configured so as to releasably receive said tab therein.

8. The device as claimed in claim 1 wherein said indexing member comprises at least three outwardly extending tabs positioned upon the surface of said plug portion.

9. The device as claimed in claim 8 wherein said indexing receiver comprises at least three channels positioned upon the surface of said basket portion, said channels each having one enclosed end and dimensioned and configured so that each of said channels may releasably receive one of said tabs therein.

10. The device as claimed in claim 1 wherein said indexing member comprises at least one outwardly extending tab positioned upon the surface of said basket portion.

11. The device as claimed in claim 10 wherein said indexing receiver comprises at least one channel formed upon the surface of said plug portion, said channel having one enclosed end and dimensioned and configured so as to releasably secure said tab therein.

12. The device as claimed in claim 1 wherein said indexing member comprises at least three outwardly extending tabs positioned upon the surface of said basket portion.

13. The device as claimed in claim 12 wherein said indexing receiver comprises at least three channels positioned upon the surface of said plug portion, each of said channels having one enclosed end and dimensioned and configured so that each of said channels may releasably receive one of said tabs therein.

14. The device as claimed in claim 1 wherein said basket portion and said plug portion are formed from rubber, plastic or metal.

15. The device as claimed in claim 1 wherein said basket portion is configured and dimensioned to be receivable within the existing sink basket of a sink.

16. A sink basket and plug assembly comprising:

(i) a basket portion, said basket portion including a well having a side surface and a bottom, said bottom of said well having at least one fluid passageway extending therethrough, said side surface having formed thereon at least one indexing receiver in the form of a generally vertically oriented channel having an enclosed lower end, said side surface of said well further including a leading and a trailing ramp positioned on opposite sides of said channel; and, (ii) a plug portion at least partially receivable within said well of said basket portion, said plug portion having an open and a closed position, when in said closed position said plug portion restricting the flow of fluids through said fluid passageway in said well, when in said open position said plug portion permitting the flow of fluids through said fluid passageway in said well, said plug portion including a side surface with at least one indexing member in the form of an outwardly extending tab, when said plug portion is in said closed position and rotated said tab engages said leading ramp such that with continued rotation of said plug portion said engaged leading ramp urges said tab into said channel to place and maintain said plug portion in said open position.

17. The device as claimed in claim 16 wherein said basket portion includes at least three channels positioned about said side surface of said well and said plug portion includes at least three tabs positioned about said side surface of said plug portion, each of said channels having one enclosed end, said tabs alignable with said channels when said plug portion is releasably received within said well.

18. A sink basket and plug assembly comprising:

(i) a basket portion, said basket portion including a well having a side surface and a bottom, said bottom of said well having at least one fluid passageway extending therethrough, said side surface including at least one indexing member in the form of an outwardly extending tab; and, (ii) a plug portion at least partially receivable within said well of said basket portion, said plug portion having an open and a closed position, when in said closed position said plug portion restricting the flow of fluids through said fluid passageway in said well, when in said open position said plug portion permitting the flow of fluids through said fluid passageway in said well, said plug portion including a side surface having at least one indexing receiver in the form of a generally vertically oriented channel having an enclosed upper end, said side surface of said plug portion further including a leading and a trailing ramp positioned on opposite sides of said channel, when said plug portion is in said closed position and rotated said leading ramp engages said tab such that with continued rotation of said plug portion said leading ramp causes said plug portion to be lifted until said channel is received over said tab with said plug portion maintained in said open position.

19. The device as claimed in claim 18 wherein said plug portion includes at least three channels positioned about its side surface and said basket portion includes at least three tabs positioned about said side surface of said well, said tabs alignable with said channels when said plug portion is releasably received within said well.

* * * * *